United States Patent [19]

Barger

[11] 4,410,111

[45] Oct. 18, 1983

[54] STORAGE CONTAINER FOR PARTICULATE MATERIAL

[76] Inventor: Lloyd D. Barger, 1520 N. Lexington Pkwy., St. Paul, Minn. 55117

[21] Appl. No.: 200,071

[22] Filed: Oct. 24, 1980

[51] Int. Cl.[3] ..... B65D 90/66; F16K 51/00

[52] U.S. Cl. ..... 222/509

[58] Field of Search ..... 222/185, 509, 510; 52/194, 197; 251/144

[56] References Cited

U.S. PATENT DOCUMENTS

| | | | |
|---|---|---|---|
| Re. 29,385 | 9/1977 | Miksitz | 222/185 X |
| 2,577,927 | 12/1951 | Stockmar | 222/509 |
| 2,788,809 | 4/1957 | Paton | 222/185 X |
| 3,115,281 | 12/1963 | Somme | 222/185 X |
| 3,448,771 | 6/1969 | Bales, Jr. et al. | 251/144 X |
| 3,556,469 | 1/1971 | Barger | 222/510 X |
| 3,602,400 | 8/1971 | Cooke | 222/185 |
| 3,823,852 | 7/1974 | Nikowitz | 222/185 |

*Primary Examiner*—Robert B. Reeves
*Assistant Examiner*—Edward M. Wacyra
*Attorney, Agent, or Firm*—Zarley, McKee, Thomte, Voorhees & Sease

[57] ABSTRACT

A storage container for particulate material designed to provide an even flow from the bottom of the container of grain or the like contained therein. The discharge port features a cone-shaped valve which is suspended by a plurality of symmetrically spaced, threadably supported cables, and is adapted to tightly seal the discharge port when closed.

4 Claims, 3 Drawing Figures

STORAGE CONTAINER FOR PARTICULATE MATERIAL

BACKGROUND OF THE INVENTION

Traditionally grain storage tanks unload from the top, exposing workmen to the risk of falling into the tank and suffocating. Also, unloading from the top meant that the last material in was the first out, and uniform discharge of the encased material by succeeding layers was very difficult. Gravity flow discharge is not new in the context of railway hopper cars; and a patent has dealt with gate valves for material storage containers on train hoppers or the like (i.e., U.S. Pat. No. 3,556,479), wherein traditional slide gates were discarded in favor of a wedge or pyramid shaped valve operatively connected to the top of the container. While such a gate valve provided novel features of operation of the valve from above, utilization of the weight of the container's contents to seal the valve, protection of the valve mechanism from the elements and relatively even flow of the contained material, either hydraulic means or a threadable shaft and hand wheel arrangement were contemplated as constituting the drive means to raise the valve against the weight of the contained material, thereby permitting the container to empty. Further, a wedge or pyramid shaped valve connected to a threadable shaft or a hydraulic opening means required an additional valve member attached to the bottom of the container to engage the valve in order to prevent it from rotating while material flowed out. Thus, an axially asymmetrical valve added complexity to the container and its discharge means.

SUMMARY OF THE INVENTION

A storage container for particulate material with a gate valve which seals a bottom discharge port is disclosed. The gate valve is symmetrical about its vertical axis and is operatively connected to the top of a storage container in a simple, yet efficacious, manner. The valve is cone-shaped and centered above a central discharge port at the bottom of an encasing shell. The valve is supported by three equally spaced cables, threadably and adjustably attached to the top of the storage container and connected to an eyelet at the apex of the valve. The encasing shell is supported by legs which elevate the bottom of the shell such that access to the discharge port is afforded from underneath. An opening is provided at the top of the encasing shell for convenient loading of particulate material.

An object of this invention is to provide a storage container for particulate material with discharge ports at the bottom which can be operated from the top of the container.

Another object of this invention is to seal the discharge port by utilizing the weight of the contained material.

Another object of this invention is to provide a storage container wherein it is virtually impossible for workmen to be immersed in the contained material during the unloading process and thereby injured.

Another object of this invention is to provide a gate valve wherein all parts are enclosed.

Another object of this invention is to afford an even flow of material from all areas of the discharge port opening.

Another object of this invention is to discharge contained material in succeeding layers from the bottom upward.

Another object of this invention is to adjust the valve opening from the top of the container by simple, yet efficacious means.

A further object of this invention is to support said valve in a manner whereby rotation of the gate valve is prevented, or if rotation occurs, the valve will still seal tightly when in a closed position and will still provide even particulate flow when in the open position.

DESCRIPTION OF THE PREFERRED EMBODIMENT

Figure 1:
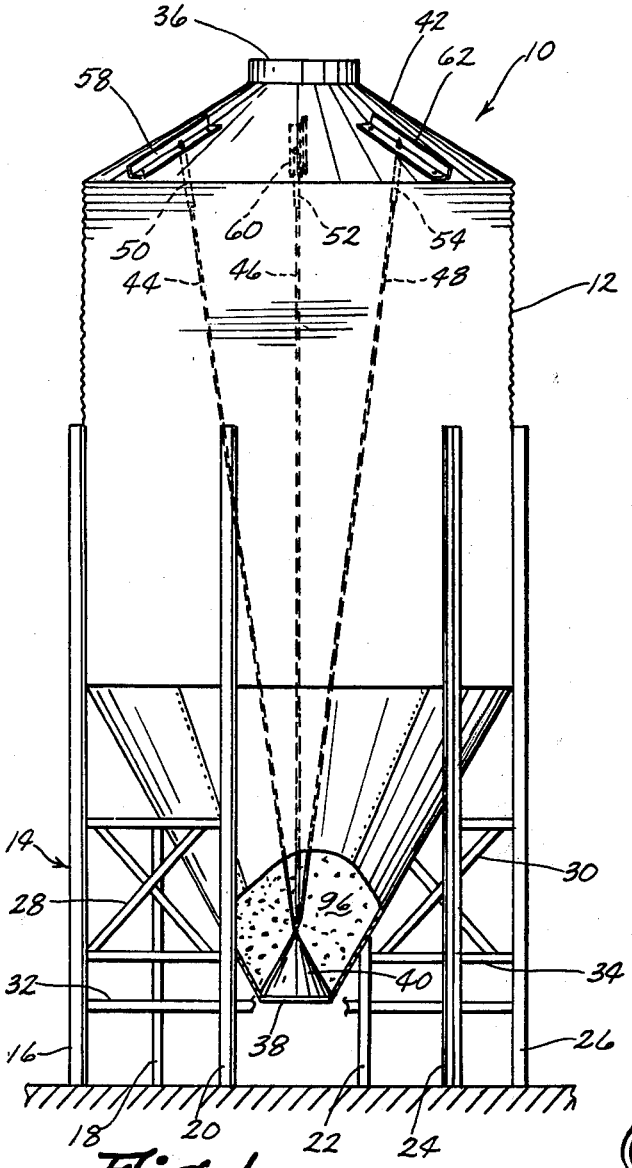
FIG. 1 is a sectional view of the side of a storage container for particulate material with the discharge valve in a closed position.

As depicted in FIG. 1, the storage container 10 is generally comprised of an encasing shell 12, for containing particulate material which is supported by an undercarriage 14, consisting of legs 16, 18, 20, 22, 24 and 26, and cross supports 28, 30, 32 and 34. The shell has an opening at the top 36 which can be covered. A centrally located discharge port 38 is provided at the bottom of the shell and can be closed by a cone-shaped valve 40. The legs 16, 18, 20, 22, 24 and 26 are of a height to afford access to the discharge port 38 from underneath.

Figure 2:
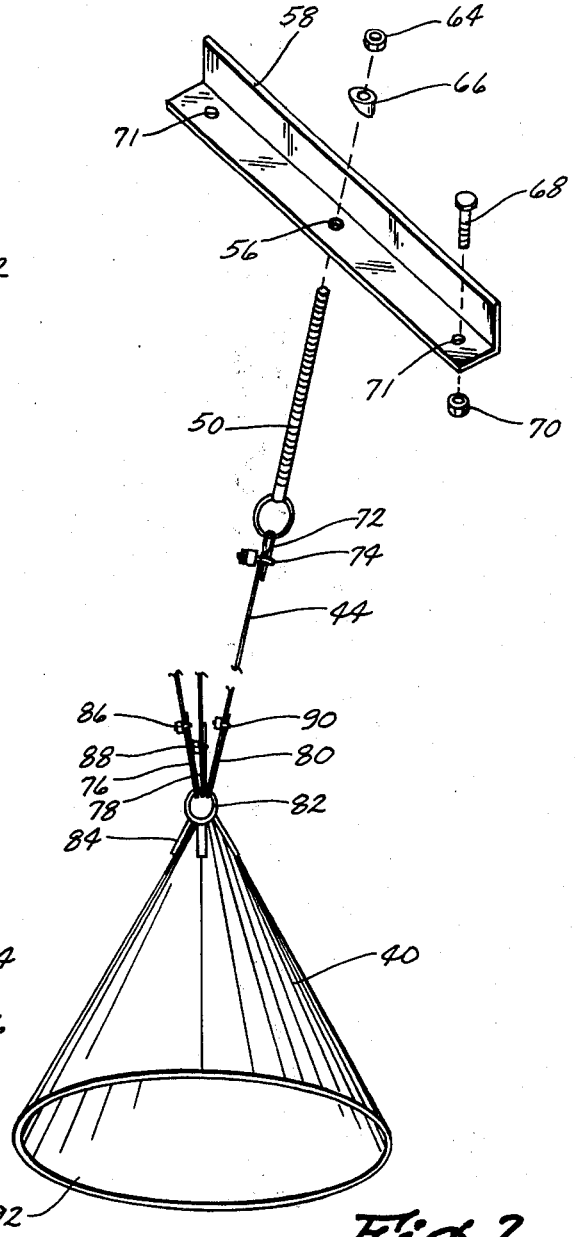
FIG. 2 is an exploded perspective view of the cable suspension means of the valve.

The valve is suspended from the top of the shell 42 by three cables, 44, 46 and 48, which are attached to the top of the shell 42 by three threaded eye bolts 50, 52 and 54. The eye bolts 50, 52 and 54 pass through the shell and through a hole 56 in the approximate center of one of three angle irons 58, 60 and 62, which lie flush against the outside of the top of the shell 42. An angle iron 58 is displayed in FIG. 2 showing a nut 64, and washer 66 arrangement to fix the eye bolt 50 to angle iron 58. The angle irons 58, 60 and 62 are spaced 120° from each other and attach to the outside of the top of the shell 42 by a bolt 68, nut 70, and hole 71 arrangement. The cables 44, 46 and 48 loop 72 around the eye bolts 50, 52 and 54 as depicted in FIG. 2, and are fastened thereto by clamps 74. The cables again loop 76, 78 and 80 around an eyelet 82 which is attached to the apex 84 of the cone-shaped valve 40, and are fastened by clamps 86, 88 and 90. The base edge 92 of the valve 40 is shaped to seal the discharge port 38 when resting flush with the inner edge 94 of the discharge port 38.

Figure 3:
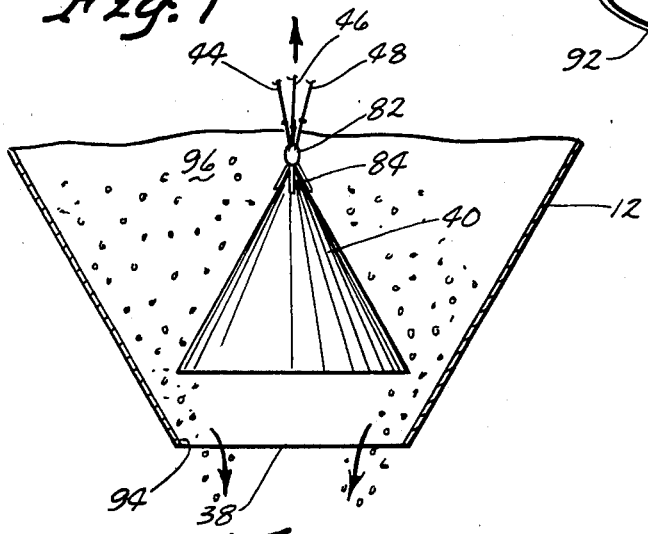
FIG. 3 is a partial sectional view of the side of a storage container discharge port showing the valve in an open position.

In operation, particulate material 96 presses on the valve 40 and forces the base edge 92 to seal the discharge port 38 until the eye bolts 50, 52 and 54 are adjusted by the nut 64 and washer 66 which attach the cables 44, 46 and 48 to the respective angle irons 58, 60, and 62. The valve 40 can thus be raised as indicated in FIG. 3, thereby allowing the particulate material 96 to flow downward and outward. Equal adjustment of all three eye bolts 50, 52 and 54 will leave the valve 40 level with respect to the discharge port 38 and symmetrical with respect to the valve's 40 vertical axis, thus the gravitational generated particulate flow will remain even around the entire circumference of the valve base edge 92. Bottom layers of particulate material will flow out first, followed by succeeding layers. This allows separate discharge of different vertically stored particulate material without mixing of the same.

It is clear from the above description that the storage container 10 will accomplish at least all of its stated objectives.

What is claimed is:

1. A storage container for particulate material comprising, encasing means for said material including side, top and bottom members and a central vertical axis, a centrally located filler opening in said top member and a cover for said opening, discharge flow regulating means which is operatively connected to the top member of said encasing means and includes a discharge valve member which is symmetric about its vertical axis, a centrally located discharge port in said bottom member, said discharge flow regulating means including a plurality of tension members which suspend said valve member symmetrically about its central axis, said tension members having lower ends connected to said valve member and upper ends vertically adjustably connected to said top member at positions generally uniformly radially spaced from the central vertical axis radially outwardly from said filler opening and generally uniformly circumferentially spaced apart, said filler opening thereby being free of obstruction by said tension members.

2. The device of claim 1 wherein said tension members comprise cables threadably and adjustably attached to said top member.

3. The device of claim 2 wherein said valve member can be adjustably raised or lowered by said cables whereby said discharge port is alternately opened and sealed.

4. The device of claim 3 wherein said valve member is cone-shaped.

* * * * *